United States Patent [19]

Johansson

[11] Patent Number: 4,514,952

[45] Date of Patent: May 7, 1985

[54] ROOF PANEL MOUNTING CLIP

[75] Inventor: Bengt Johansson, Blidö , Sweden

[73] Assignee: Maskingruppen 82 AB, Täby, Sweden

[21] Appl. No.: 493,037

[22] Filed: May 9, 1983

[30] Foreign Application Priority Data

Jul. 8, 1982 [SE] Sweden ..... 8204222

[51] Int. Cl.[3] ..... E04D 1/00; E04D 1/34

[52] U.S. Cl. ..... 52/713; 52/528; 52/543; 52/520

[58] Field of Search ..... 52/543, 544, 545, 546, 52/547, 520, 521, 522, 523, 524, 525, 526, 527, 528, 537, 538, 541, 698, 712–715, 630, 721, 748, 765

[56] References Cited

U.S. PATENT DOCUMENTS

| | | | |
|---|---|---|---|
| 1,882,105 | 10/1932 | Wender | 52/520 |
| 3,111,788 | 11/1963 | Ouellet | 52/537 |
| 3,889,439 | 6/1975 | Day et al. | 52/520 |
| 3,903,670 | 9/1975 | Robinson, Jr. | 52/547 |
| 4,224,775 | 9/1980 | Heckelsberg | 52/528 |
| 4,296,581 | 10/1981 | Heckelsberg | 52/544 |

FOREIGN PATENT DOCUMENTS

| | | | |
|---|---|---|---|
| 706575 | 3/1965 | Canada | 52/544 |
| 1266994 | 6/1961 | France . | |
| 1384089 | 12/1965 | France | 52/528 |
| 222382 | 9/1968 | Sweden . | |
| 420008 | 9/1981 | Sweden . | |
| 175583 | 5/1935 | Switzerland . | |
| 999569 | 7/1965 | United Kingdom . | |

*Primary Examiner*—John E. Murtagh
*Assistant Examiner*—Andrew Joseph Rudy
*Attorney, Agent, or Firm*—Hill, Van Santen, Steadman & Simpson

[57] ABSTRACT

A sliding mounting clip for holding sheet metal roof panels for example, to a supporting structure comprises an anchoring member having a horizontal base flange and an upstanding web with a horizontal upper edge, and a tab member formed of a sheet metal strip and slidably attached to the upstanding web of the anchoring member. One end portion of the tab member strip is folded a full turn about a bridge in the upstanding web which is defined by the upper edge of the web and a horizontal closed slot formed in the web. The tab member is frictionally yieldably held in a center position on the bridge by a pair of embossments formed in the bridge.

7 Claims, 2 Drawing Figures

ROOF PANEL MOUNTING CLIP

BACKGROUND OF THE INVENTION

1. Field of the Invention

This invention relates to a roof panel mounting clip for securing roof panels of sheet metal to a supporting structure. More particularly, the invention relates to a roof panel mounting clip permitting the roof panels to move relative to the supporting structure, e.g. upon thermal expansion or contraction of the panels.

2. Prior Art

A prior art roof panel mounting clip designed to permit the roof panels to move relative to the supporting structure without subjecting the clips or the supporting structure to undue stresses is shown in Swedish Pat. No. 222,382. This mounting clip comprises an anchoring member having a horizontal base flange and a vertical web with a horizontal closed slot, and a tab member slidably mounted on a bridge portion defined in the vertical anchoring member web between the slot and the upper edge of the web. The anchoring member is adapted to be secured to the supporting structure by nails or other suitable fasteners, whereas an upstanding portion of the tab member is adapted to be engaged with a longitudinal flange of one of two contiguous roof panels which are subsequently joined by seaming interengaged longitudinal flanges together to form a so-called standing seam in which the tab member is interleaved.

In this prior art clip the tab member is formed of a sheet metal strip inserted in the slot of the anchoring member web and folded upwardly upon itself about the bridge portion. The upwardly extending limbs are of approximately the same length and are offset in the longitudinal direction of the bridge portion such that they do not overlap one another in the seam, thereby minimizing the amount by which the thickness of the seam is increased in the region of the clip owing to the interleaving of the tab member. However, the cost of this advantage is a considerable waste of material resulting from the special shape of the tab member strip which is due to the offsetting of the limbs.

A further prior art clip is shown in Swedish Pat. No. 7802814-9 (Publication No. 420,008). In this clip, the tab member is also formed by a sheet metal strip folded upwardly upon itself about the bridge portion. However, the limb on one side of the bridge portion extends only slightly above the upper edge of the bridge portion. In order that the tab member may be capable of withstanding the forces applied by the roof panels tending to rip it away from the bridge portion, the limbs are welded or riveted together immediately above the upper edge of the bridge portion. However, the welding or riveting of the limbs complicates the production of the clip.

SUMMARY OF THE INVENTION

An object of the invention is to provide a sliding clip which can be produced with very little waste of material and which lends itself to production by simple means and with little or no manual labor. A further object is to provide a sliding clip which meets strict requirements on strength and which is as easy to apply as the prior art clips.

These objects are achieved by constructing the clip as set forth in the claims.

As will become apparent from the following detailed description, an essential element of the invention resides in the discovery of the fact that a sufficiently reliable and strong connection of the tab member to the anchoring member can be realized merely by folding one end portion of the tab member strip about the bridge portion in a special way, that is, without it being necessary to secure together the strip limbs immediately above the bridge portion, such as by welding or riveting.

Other objects, advantages and features of the invention will be understood from the following description of the preferred embodiment with reference to the drawing.

DESCRIPTION OF THE PREFERRED EMBODIMENT

Figure 1:
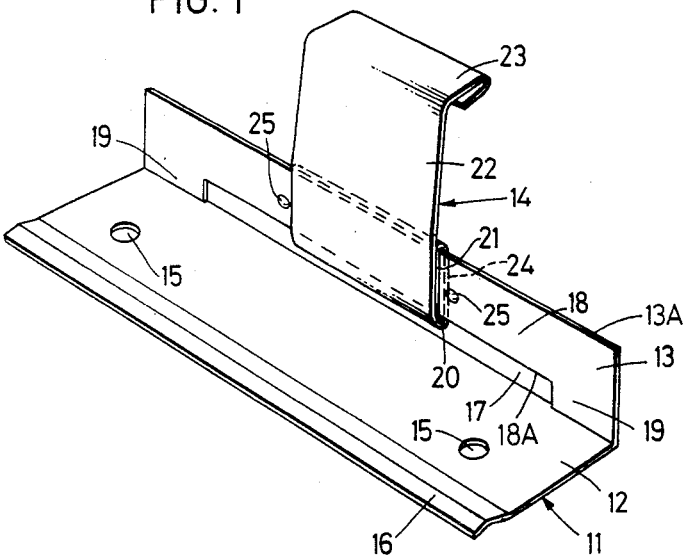
FIG. 1 is a perspective view of a roof panel mounting clip embodying the invention.

As shown in FIG. 1 the roof panel mounting clip comprises two parts, namely, an L-shaped sheet metal anchoring member 11 having a horizontal base flange 12 and a vertically upstanding integral web 13, and a tab member 14 which is slidably connected to the anchoring member web 13 and formed of a folded sheet metal strip of uniform width.

A pair of holes 15 for nails or other suitable fasteners is provided in the base flange 12 to facilitate the securement of the anchoring member 11 to a supporting structure to be covered with sheet metal roof panels. A longitudinal ridge 16 is formed adjacent to the outer or free longitudinal edge of the base flange 12.

The upstanding web 13 of the anchoring member 11 is formed with a horizontal closed slot 17 extending over the major portion of the length of the anchoring member. This slot 17 defines with the upper edge 13A of the web a bridge portion 18 of uniform height and a length substantially greater than the width of the strip. At its ends, the bridge 18 is integrally connected with the horizontal base flange 12 through the end portions 19 of the web 13 which also define the ends of the slot 17. The bridge 18 supports the tab member 14 which is displaceable along the bridge within a range limited by the end portions 19.

The tab member 14 is nonremovably mounted on the bridge 18 in that one end portion of the tab member strip is folded a full turn about the bridge such that the terminal edge 20 is directed downwardly and approximately level with the lower edge 18A of a bridge 18, the strip segment 21 forming part of the folded end portion and bordered by the terminal edge 20 being on the inner side of the bridge 18, that is, the side on which the base flange 12 is situated. Accordingly, an upstanding tab member portion 22, the upper end of which is formed with a hook-like flange 23, is positioned on the same side and overlies the segment 21.

Both the just-mentioned segment 21 and the adjoining segment 24, which is positioned on the outer side of the bridge 18 (the side facing away from the base flange 12), are flat and have a sliding fit with the bridge 18 so that the tab member 14 can readily slide along the bridge.

A relatively small vertical clearance exists between the bridge 18 and the curved segments or portions of the tab member strip which join the segment 21 with the segment 24 and join the segment 24 with the upstanding tab member portion 22, so as to permit the sliding movement but to minimize the danger of the tab member's 14 becoming tilted and jammed.

When the clip is produced, the tab member 14 is placed in a center position on the bridge 18 and frictionally retained in that position by a pair of embossments or nipples 25 on the inner side of the bridge 18. The nipples 25 are positioned substantially symmetrically with respect to the ends of the bridge 18 and spaced apart by a distance slightly larger than the width of the tab member 14. They are relatively small, so that the tab member 14 can be displaced from the central position when acted on in the longitudinal direction of the bridge by forces resulting from thermal expansion and contraction of the roof panels held by the clip. The yieldable frictional locking of the tab member 14 in the central position facilitates the mounting of the clip, because the tab member need not be manually adjusted to the center position.

Figure 2:
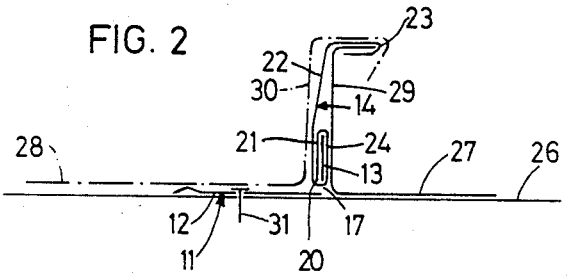
FIG. 2 is a diagrammatic cross-sectional view illustrating the use of the clip shown in FIG. 1.

FIG. 2 illustrates the use of the sliding clip of FIG. 1 when covering a supporting structure 26 with two contiguous sheet metal roof strips or panels 27 and 28 provided with longitudinal flanges 29 and 30, respectively, each including a laterally extending portion. After the panel 27 has been laid on the supporting structure 26, the clip is engaged with the flange 29 and then secured to the supporting structure 26 by means of nails 31. Then the other panel 28 is engaged by its flange 30 over both the hook-like flange 23 of the tab member 14 and the flange 29 of the previously laid panel 27. The laterally extending portions of the flanges 29 and 30 are then folded down together with the hook-like flange 23 by means of a so-called roof seamer, so that the tab member 14 is securely clamped between the flanges 29 and 30.

The folding of one end portion of the tab member strip a full turn about the bridge 18 of course means that in addition to the anchoring member web 13 three strip layers, namely, the segments 21 and 24 and the upstanding portion 22, become interleaved between the flanges 29 and 30 of the roof panels, whereas with the prior art clips discussed above only two tab member layers will be interleaved between the flanges. This added layer of the present invention is of no significant disadvantage because the anchoring member web 14 and two of the layers, those formed by the segments 21 and 24, have a relatively small vertical extent. Thus, at the upper region of the panel flanges 29 and 30, that is, the regions acted on by the roof seamer, only a single tab member layer, formed by the upper part of the upstanding tab member portion 22, becomes interleaved between the panel flanges.

The positioning of the upstanding tab member portion 22 on the side of the bridge 18 where the base flange 12 is positioned is preferred for reasons of strength. However, it is within the scope of the invention to position the upstanding tab member portion 22, and thus also the segment 21, on the opposite side of the bridge 18.

I claim:

1. Roof panel mounting clip, comprising a sheet metal anchoring member having a horizontal base flange and an integral upstanding web with a horizontal upper edge and a horizontal closed slot defining with said upper edge a bridge in said web, and a tab member formed of a sheet metal strip substantially narrower than the horizontal extent of said slot, one end portion of said strip being folded a full turn about said bridge and having its terminal edge of said turn directed downwardly and spaced between said upstanding web and an upstanding portion of said tab member, the other end portion of said strip being adapted to be engaged with a roof panel.

2. Roof panel mounting clip according to claim 1, said terminal edge being approximately even with a lower edge of said bridge.

3. Roof panel mounting clip according to claim 1, said anchoring member being L-shaped in cross-section and the segment of said one strip end portion bordered by said terminal edge being on the side of said web facing in the direction in which said base flange extends.

4. Roof panel mounting clip according to claim 1, said web having a pair of embossments positioned symmetrically with respect to the ends of said bridge and spaced apart by a distance slightly larger than the width of said strip.

5. A roof panel mounting clip according to claim 1, there being only a small vertical clearance between said bridge and the curved portions of said full turn, whereby danger of tilting or jamming said tab member is minimized.

6. A roof panel mounting clip according to claim 2, said anchoring member being L-shaped in cross-section and the segment of said one strip end portion bordered by said terminal edge being on the side of said web facing in the direction in which said base flange extends.

7. A roof panel mounting clip according to claim 2, said web having a pair of embossments positioned symetrically with respect to the ends of said bridge and spaced apart by a distance slightly larger than the width of said strip.

* * * * *